US007753102B2

(12) United States Patent
Kutaragi

(10) Patent No.: US 7,753,102 B2
(45) Date of Patent: Jul. 13, 2010

(54) LOW-PRESSURE PRODUCTION OF CAST ARTICLE

(75) Inventor: Yoshikazu Kutaragi, Higashimatsuyama (JP)

(73) Assignee: Bridgestone Corporation, Tokyo (JP)

( * ) Notice: Subject to any disclaimer, the term of this patent is extended or adjusted under 35 U.S.C. 154(b) by 393 days.

(21) Appl. No.: 11/896,686

(22) Filed: Sep. 5, 2007

(65) Prior Publication Data

US 2008/0053636 A1 Mar. 6, 2008

(30) Foreign Application Priority Data

Sep. 5, 2006 (JP) ..... 2006-239765

(51) Int. Cl.
*B22D 27/11* (2006.01)

(52) U.S. Cl. ..... 164/76.1; 164/270.1; 29/527.5

(58) Field of Classification Search ..... 164/76.1, 164/270.1; 29/527.5
See application file for complete search history.

(56) References Cited

FOREIGN PATENT DOCUMENTS

| | | | |
|---|---|---|---|
| GB | 1 439 180 | | 6/1976 |
| GB | 2 409 423 | A | 6/2005 |
| JP | 57-58968 | A | 4/1982 |
| JP | 60-44151 | * | 3/1985 |
| JP | 61-1422 | A | 1/1986 |
| JP | 61-95760 | A | 5/1986 |
| JP | 56-1244 | A | 1/1991 |
| JP | 8-164468 | A | 6/1996 |

* cited by examiner

*Primary Examiner*—Kuang Lin
(74) *Attorney, Agent, or Firm*—Sughrue Mion, PLLC

(57) ABSTRACT

Method for highly efficiently producing a cast article by a low-pressure casting process, wherein a molten metal is charged into a mold cavity of a gypsum mold. The cast metal immediately after its solidification is rectified into a final shape, in a state in which the solidified metal is either still integral with the gypsum mold or removed therefrom, requiring minimized time for rectification and cooling.

2 Claims, 2 Drawing Sheets

LOW-PRESSURE PRODUCTION OF CAST ARTICLE

TECHNICAL FIELD

The present invention relates to a method for producing cast article by carrying out a low-pressure casting process with a gypsum mold.

BACKGROUND ART

There have been various proposals regarding a low pressure casting method, wherein a molten metal is pressurized and filled into a cavity of a gypsum mold through a pipe so as to perform casting.

Thus, for example, Japanese Patent Application Laid-open Publication No. 61-95760 discloses a method wherein the inner space of the gypsum mold is subjected to pressure reduction so as to suck a molten metal. In this instance, the molten metal is allowed to cool after it has solidified in the mold cavity, and the cast metal is removed from the mold after it completion of the cooling.

DISCLOSURE OF THE INVENTION

As known in the art, the cast metal undergoes shrinkage deformation during the cooling, thereby causing strain in shape of the final product. In the case of rapid cooling, in particular, it is necessary to sufficiently adopt a sufficient cooling period for the solidified metal, in view of a significant degree of strain in the cast product.

The shrinkage deformation of the solidified metal is more or less unavoidable even in the case of a natural cooling. Therefore, it has been necessary to carry out a shape rectification for the cast product under a normal temperature condition, after completion of its solidification and removal from the gypsum mold. This means that the conventional method suffers from a long time for the cooling and a long time for the subsequent rectification, thereby degrading the production efficiency.

The present invention has been achieved in view of such a problem. It is a primary object of the present invention to provide a method and an apparatus capable of highly efficiently producing a cast article by a low pressure casting process, with a minimized strain.

To this end, a first aspect of the present invention resides in a method for producing a cast article, comprising: performing a low-pressure casting process wherein a molten metal is cast into a mold cavity of a gypsum mold and caused to solidify within the gypsum mold; and rectifying the cast metal into a final shape of said article, immediately after it has solidified, in a state in which the metal is still integral with the gypsum mold.

With the method according to the first aspect of the present invention, since the cast metal is rectified into a final shape of the article, immediately after it has solidified, in a state in which the metal is still integral with the gypsum mold, it is possible to obtain the final shape of the cast article while suppressing the strain due to the shrinkage deformation of the solidified metal during the cooling, with the result that the cast article can be highly efficiently produced with the minimized strain and within a minimized time.

It is preferred that the rectification of the solidified metal is carried out by applying a pressure to the solidified metal by a die, together with the gypsum mold. In this instance, it is possible to carry out rectification of the cast metal easily and without incurring noticeable equipment cost. Moreover, if the press die is provided with a predetermined pattern, such pattern is transcribed to the cast product during its cooling so as to provide a further improved production efficiency.

It is further preferred that the rectification of the solidified metal is carried out by applying a pressure to the solidified metal by a die, while maintaining the die at a temperature which is lower than that of the solidified metal. In this instance, it is possible to suppress strain of the solidified metal within the minimized time for rectification, so as to provide a further improved production efficiency within the minimized cooling time.

A second aspect of the present invention resides in a method for producing a cast product, comprising: performing a low-pressure casting process wherein a molten metal is cast into a mold cavity of a gypsum mold and caused to solidify within the gypsum mold; removing the cast metal from the gypsum mold, immediately after it has solidified, and setting the solidified metal to a press die; and rectifying the cast metal into a final shape of said article, by applying a pressure to the solidified metal by the press die.

With the method according to the second aspect of the present invention, since the solidified metal removed from the gypsum mold is set to the press die and subjected to rectification by applying a pressure from the press die, it is possible to highly efficiently produce the cast article with the minimized strain. Moreover, if the press die is provided with a predetermined pattern, such pattern is transcribed to the cast product during its cooling so as to provide a further improved production efficiency.

A third aspect of the present invention resides in an apparatus for producing a cast article, comprising: low pressure casting means for casting a molten metal into a mold cavity of a gypsum mold; die means for rectifying the cast metal into a final shape of said article, in cooperation with the gypsum mold; and press means for applying a pressure to the cast metal through said die means.

The apparatus according to the third aspect of the present invention it is possible to carry out rectification of the cast metal easily, without incurring noticeable equipment cost.

BRIEF DESCRIPTION OF THE DRAWINGS

The present invention will be further described below with reference to preferred embodiments thereof, which are illustrated in the accompanying drawings, wherein.

REFERENCE NUMERALS

1: Molten metal

2: Solidified metal

Figure 1:
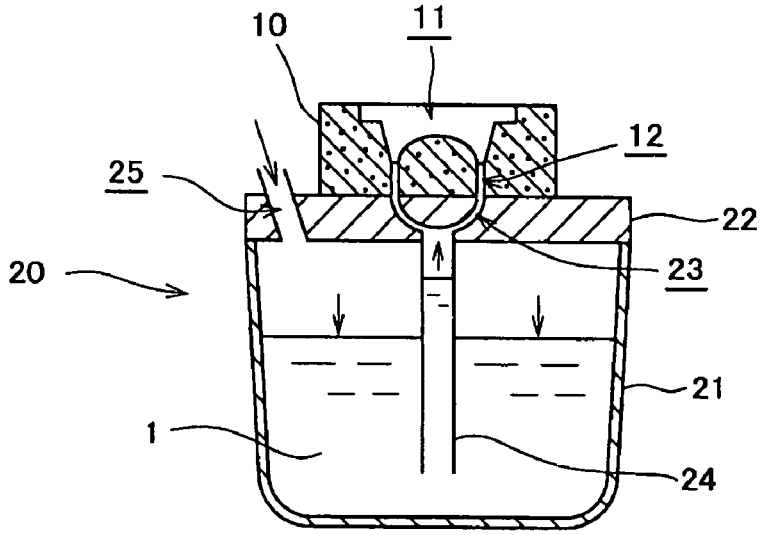
FIG. 1 is a schematic view showing a low-pressure casting apparatus and a gypsum mold, which are used in the method for producing a cast article according to the present invention.

3: Cast article
10: Gypsum mold
11: Mold cavity
12: Runner
20: Low-pressure casting apparatus
21: Furnace
22: Cover member
23: Runner
24: Pipe
25: Gas inlet
30: Rectification press device
31: conveyor belt
32: Anvil
33: Vertical cylinder
34: Platen
36: Column
37: Horizontal beam

BEST MODE FOR CARRYING OUT THE INVENTION

There is schematically shown in FIG. 1 a low-pressure casting apparatus 20 and a gypsum mold 10, which are used in the method for producing a cast article according to the present invention. The cast article may be a metal mold forming a unit segment in a segmented mold system for producing pneumatic tires.

The casting apparatus 10 includes a furnace 21 in which molten metal 1 is formed. The furnace 21 has an open end that is closed by a cover member 22. The gypsum mold 10 is arranged at a predetermined location on the cover member 22. The gypsum mold 10 has a mold cavity 11 therein, and a runner 12 that is formed through the bottom wall of the gypsum mold 10 in communication with the mold cavity 11.

The cover member 22 is formed with a runner 23 that is in communication with the runner 12 of the gypsum mold 10, and a pipe 24 that projects downwards into the furnace 21. The pipe 24 has an upper end communicated with the runner 23, and a lower end immersed in the molten metal 1 that is stored within the furnace 21.

The cover member 22 is further provided with a gas inlet 25, through which compressed gas can be supplied into the furnace 21. As shown by arrows in FIG. 1, the compressed gas supplied from the inlet 25 into the furnace 21 serves to apply a pressure onto the liquid surface of the molten metal 1 so that the molten metal 1 is pushed upwards through the pipe 24 and charged into the mold cavity 11 of the gypsum mold 10 through the runners 23, 12 to fill the mold cavity 11.

Figure 2:
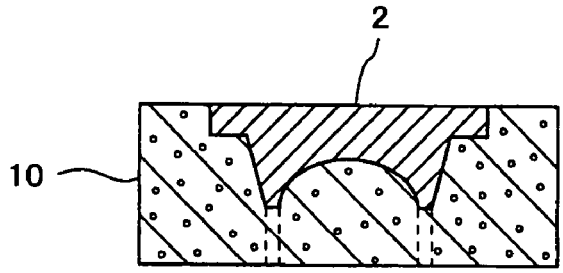
FIG. 2 is a sectional view showing the gypsum mold and cast metal immediately after solidification of the latter.

When the molten metal 1 filling the mold cavity 11 of the gypsum mold 10 solidifies, a cast article 2 is obtained as shown in FIG. 2. Immediately after solidification of the molten metal 1 within the mold cavity 11, the gypsum mold 10 is removed from the cover member 22 of the casting apparatus 20 and transferred to a rectifying press device 30.

Figure 3:
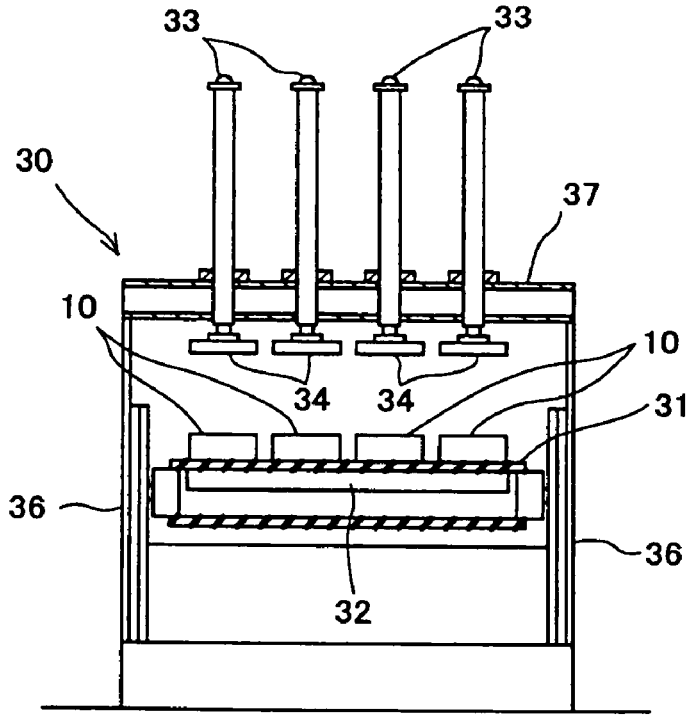
FIG. 3 is a schematic view showing one example of the pressing die used for rectification of the cast metal.
Figure 4:
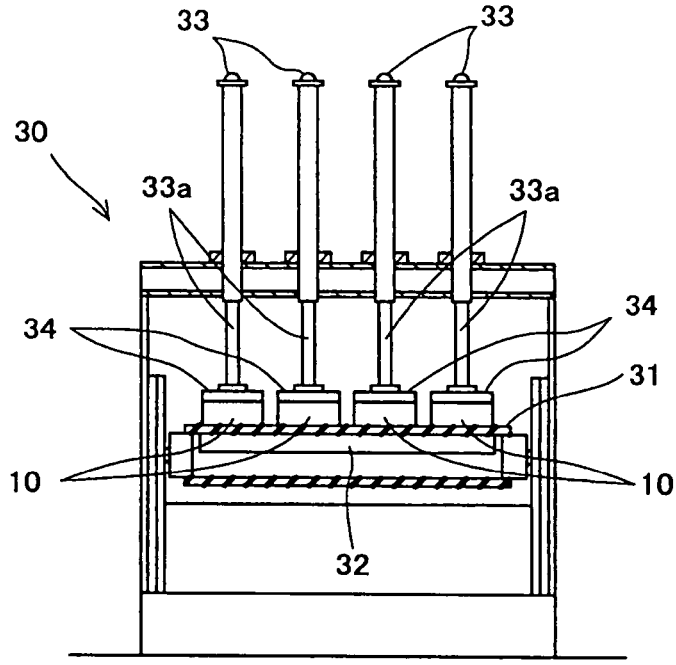
FIG. 4 is a schematic view showing another example of the pressing die used for rectification of the cast metal.

As shown in FIG. 3 or 4, the rectifying press device 30 includes a conveyor belt 31 for conveying a plurality of gypsum molds 10 (e.g., four molds), which are arranged in the width direction. An anvil 32 is arranged along the lower surface of the conveyor belt 31, and a plurality of vertical press cylinders 33 (e.g., four press cylinders) are arranged on the upper side of the conveyor belt 31 side by side, and supported by a horizontal beam 37 that is bridged between vertical columns 36, 36 on the right and left sides.

Each press cylinder 33 has a rod 33*a* that can be extended and retracted in the vertical direction. A platen 34 is fixedly secured to the lower ends of the rods 33*a*, and has a lower surface that is opposed to the four gypsum molds 10 arranged on the conveyor belt 31, when the gypsum molds 10 are brought into a press position.

Figure 5:
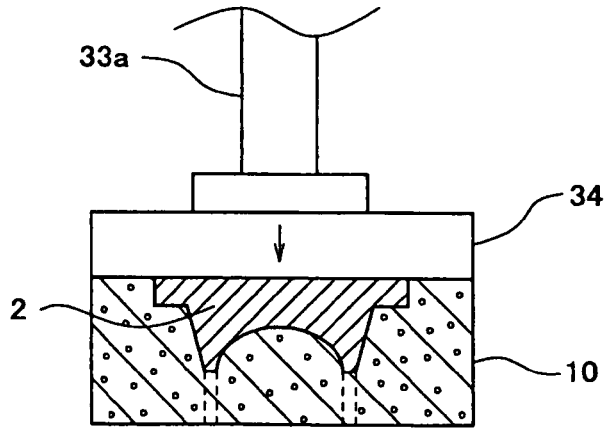
FIG. 5 is a sectional view showing the major part of FIG. 4 in enlarged scale.

In the rectifying press device 30, the platen 34 forms an upper die while a lower die is formed by the gypsum molds 10. The press cylinder 33 can be driven so as to extend the rods 33*a* to urge the platen 34 against the upper surface of the opposite gypsum molds 10 and the cast article 2, with the result that the gypsum molds 10 and the platen 34 cooperate with each other to rectify the cast article 2, as shown in FIG. 5. In this instance, it is assumed that the platen 34 is maintained at a predetermined temperature that is lower than the temperature of the cast article 2 immediately after solidification of the molten metal.

In this way, since the cast article immediately after solidification of the molten metal is transferred to the press position on the conveyor belt 34 of the rectifying press device 30 and pressed by the platen 34 from the upper side, the cast article 2 at a high temperature immediately after solidification of the molten metal is simultaneously cooled and rectified by the platen 34 at a relatively low temperature.

The rectification of the cast article by means of the platen 34 serves to prevent shrinkage deformation of the cast article due to its cooling from a high temperature, and thus suppress distortion in its shape. Once the cast product 2 has been cooled to the predetermined temperature set for the platen 34, the shape of the cast article 2 is stabilized without subsequent shrinkage deformation.

The period of time from the beginning of rectification of the cast article 2 under the pressure applied to the platen 34 at the predetermined temperature, to completion of cooling of the cast article 2 down to a temperature close to the predetermined temperature of the platen 34 is relatively short, for example about five minutes. Thus, it is sufficient to carry out rectification of the cast article only during this short period.

After completion of rectification of the cast article, the application of pressure to the platen 34 is relieved, the platen 34 is moved upwards from the gypsum molds 10 and the cast articles 2, and the cast articles are then subjected to natural cooling. At the same time, the belt conveyor 31 is operated to move the cast articles 2, which have already been subjected to rectification, are moved from the press position together with the gypsum molds 10, and to bring successive gypsum molds 10 into the press position immediately after the casting of the cast articles 2 in their mold cavities 11.

Figure 6:
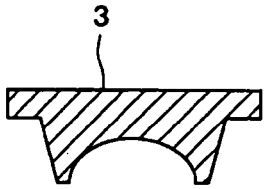
FIG. 6 is a sectional view showing the cast product obtained by the low-pressure casting process according to the present invention.

The gypsum molds 10 after the natural cooling of the cast articles are dismantled to take out the final products 3 of the cast articles. The final product has minimized distortion, as shown in FIG. 6.

It will be appreciated that the method according to the present invention makes it possible to markedly shorten the production time and significantly improve the production efficiency. This is due to the fact that the rectification of the cast article is carried out immediately after the casting and solidification of the molten metal by the low-pressure casting apparatus 20, over a short period of time under a pressure applied to the platen 34 in a state in which the cast article 2 is still within the mold cavity 11 of the gypsum mold 10, in the initial phase of cooling period. Moreover, since the cooling of the cast article during the rectification is enhanced by the platen 34 at a temperature lower than that of the cast article 2, it is possible to shorten the cooling time as compared to an entirely natural cooling.

Figure 7:
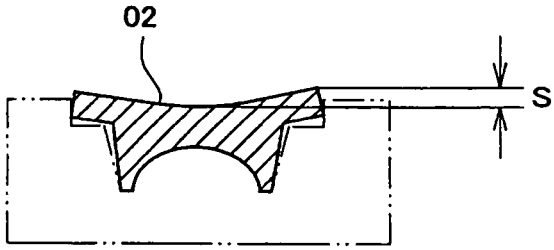
FIG. 7 is a sectional view showing the cast product obtained by the low-pressure casting process, which has not been subjected to the shape rectification.

By way of comparison, FIG. 7 shows the distortion of a cast article 02 in an exaggerated sense, which would be caused if the cast article 02 is not subjected to rectification and allowed to an entirely natural cooling, unlike the present invention.

The amount S of warping occurring in the cast article is defined as a difference in level between the highest point and the lowest point at the upper surface of the cast article 02. In the case of a cast article to be used as a segment in a segmented mold system for producing pneumatic tires, it is necessary to ensure that the amount of warping S is not more than 0.10 mm.

It has been confirmed that, when the cast article is formed by the low-pressure casting apparatus 20 and then left for a natural cooling, the amount of warping S is still as large as 0.32 mm. When the cast article immediately after its formation is cooled to a temperature of about 186° C. and the subjected to rectification for five minutes under a pressure of 0.3 kPa by a platen at a temperature of 288° C., the amount of warping S is still as large as 0.21 mm.

With such a conventional low-pressure casting method, the amount of warping of not more than 0.1 mm could be realized only when the cast article is sufficiently cooled down to a temperature of about 105° C., and then subjected to rectification for thirty minutes, under a pressure of 0.5 kPa by a platen at a temperature of 270° C. In this case, however, the production requires a long time as a whole, since a sufficient cooling time must be ensured, the rectification must be continued for as long as thirty minutes, and a subsequent cooling is further necessary.

In contrast, with the low-pressure casting method according to the present invention, it has been confirmed that the production time can be significantly shortened when, immediately after the casting of the cast article by the low-pressure casting apparatus 20 or solidification of the molten metal, the cast article at a temperature of 268° C. together with the gypsum mold 10 is rectified by the platen 34 at a temperature of 120° C. for five minutes under the pressure of 0.5 kPa, the cast article is cooled down to a temperature of 133° C., no further shrinkage deformation takes place, and the final amount S of the warping was as low as 0.8 mm. In this way, the amount of warping S of not more than 0.1 mm can be achieved by the rectification for five minutes immediately after the casting, to significantly shorten the production time.

It has been further confirmed that when, immediately after the casting of the cast article, the cast article at a temperature of 278° C. is rectified by the platen 34 at a temperature of 100° C. for five minutes under the pressure of 0.5 kPa, the cast article is cooled down to a temperature of 123° C., and the final amount S of the warping was as low as 0.04 mm. It is thus possible to highly efficiently produce the cast articles with a minimized amount of warping S as low as 0.04 mm, by the rectification for five minutes immediately after the casting.

It will be appreciated that the present invention makes it possible to highly efficiently produce cast articles with minimized amount of warping S by carrying out rectification of the cast article immediately after its formation for a short time, by the platen 34, in a state in which the cast article is still integral with the gypsum mold 10.

In this instance, if the pressure-contact surface of the platen 34 is provided with a predetermined pattern, an invented pattern can be automatically inscribed into the surface of the low-pressure cast article.

The present invention can be carried out in various manner, without being limited to the illustrated embodiment. Thus, for example, the cast article immediately after its formation in the mold cavity 11 of the gypsum mold 10 may be removed from the gypsum mold 10 and set to a separate press die, for subsequent rectification by the press die under a predetermined pressure, to highly efficiently produce cast articles with minimized amount of warping S.

In this instance also, if the press die is provided with a predetermined pattern, an invented pattern can be inscribed automatically into the surface of the low-pressure cast article.

The invention claimed is:

1. A method for producing a cast article, comprising:

performing a low-pressure casting process wherein a molten metal is cast into a mold cavity of a gypsum mold and caused to solidify within the gypsum mold;

rectifying the cast metal into a final shape of said article, immediately after it has solidified, in a state in which the metal is still integral with the gypsum mold;

wherein the rectification of the solidified metal is carried out by applying a pressure to the solidified metal by a die, together with said gypsum mold.

2. The low-pressure casting method according to claim 1, wherein the rectification of the solidified metal is carried out while maintaining the die at a temperature which is lower than that of said solidified metal.

* * * * *